United States Patent [19]

Hatakeyama et al.

[11] Patent Number: 4,635,826

[45] Date of Patent: Jan. 13, 1987

[54] TUBE CONTAINER FOR RECEIVING SEMIFLUID MATERIAL

[75] Inventors: Yoshiharu Hatakeyama, Tokyo; Tatsuo Ishikawa, Chiba, both of Japan

[73] Assignee: Yoshida Industry Co., Ltd., Tokyo, Japan

[21] Appl. No.: 819,492

[22] Filed: Jan. 16, 1986

Related U.S. Application Data

[63] Continuation-in-part of Ser. No. 551,929, Nov. 15, 1983, abandoned.

[30] Foreign Application Priority Data

Aug. 23, 1983 [JP] Japan ..... 58-129269[U]

[51] Int. Cl.[4] ..... B65D 37/00

[52] U.S. Cl. ..... 222/147; 222/213; 222/495; 215/21

[58] Field of Search ..... 222/212, 213, 491, 495, 222/496, 92, 147, 107; 215/14, 18, 20, 21, 28, 30

[56] References Cited

U.S. PATENT DOCUMENTS

| | | | |
|---|---|---|---|
| 763,914 | 6/1904 | Lewis | 215/21 |
| 1,621,923 | 3/1927 | Crisci | 215/21 |
| 3,179,300 | 4/1965 | Davidson et al. | 222/213 |
| 3,344,963 | 10/1967 | Wynes et al. | 222/495 |

*Primary Examiner*—H. Grant Skaggs

*Attorney, Agent, or Firm*—Wenderoth, Lind & Ponack

[57] ABSTRACT

A tube container for receiving semifluid material includes a tubular body formed of an elastic synthetic resin, a neck portion formed of a synthetic resin and integrally mounted on the body at a shoulder, and a valve member fitted in the neck portion. The valve member includes a side wall, an upper end plate, a valve sheet and a stopper. The side wall provides a tight fit with an inner surface of the neck portion and the end plate is formed with a passage for flow of the material to an outlet in the neck portion. Placed on the end plate is the valve sheet which is movable between the end plate and the stopper to open or close the passage in accordance with pressure applied to the body. Upper portion of the stopper is located adjacent to the outlet so as to minimize a space therebetween.

3 Claims, 3 Drawing Figures

TUBE CONTAINER FOR RECEIVING SEMIFLUID MATERIAL

BACKGROUND OF THE INVENTION

This application is a continuation-in-part of Ser. No. 551,929 filed Nov. 15, 1983, now abandoned.

The present invention relates to a tube container for receiving semifluid material such as cosmetics, ointments, foods and the like, and more particularly to a tube container comprising a tubular body formed of a synthetic resin material having elasticity, and a neck portion formed of a synthetic resin material and having an outlet at a top end thereof.

The semifluid material may be extruded from the outlet when pressure is applied to the body. Immediately after the pressure is removed, the body formed of an elastic resin, such as olefin resin, tends to expand or be restored to its original shape due to the elasticity thereof thereby maintaining a smooth external appearance. This expansion of the body generates a suction force therein because of the reduced volume of the material in the body, which causes the material having been extruded from the outlet to return into the container together with air. Such back flow is of course undesirable since it will oxidize, harden or deteriorate the material remaining in the container. Further, the air sucked into the container makes it difficult for a user to extrude the material when desired due to an imbalance of the body with regard to the remaining material. Another disadvantage caused by the back flow is a resultant mixture of the air with the material in the container, which prevents smooth extrusion of the material by causing splattering of the mixture.

Improvements for preventing the back flow as discussed above have been proposed in which the neck portion has been modified so as to permit a sheet-like valve to be mounted directly in the neck portion itself. One such tube container has a neck portion of a diameter larger than normal, while another has a bored partition formed integrally with the neck portion.

However, such neck portions require molding dies which are different from a die used for molding neck portions of the usual type, i.e. of the type where prevention of back flow is not necessary. Preparation of the respective dies for molding the respective types of neck portions has increased costs and involved separate molding work for each type.

Futhermore, in the known structures for preventing the back flow the sheet-like valve is normally situated around the lower end of the neck portion Therefore, a relatively large space is inevitably formed between the outlet and a position where the valve is normally situated. This increases volume of the semifluid material which was once discharged from the outlet and which, after the pressure is removed, returns into that space to remain therein. Thus, a customer can not use the fresh material until substantial initial amount has been extruded from the outlet.

Accordingly, an object of the present invention is to provide a tube container for receiving semifluid material which will prevent back flow of the material with air.

Another object of the present invention is the provision of a tube container which permits smooth extrusion of the semifluid material.

It is a further object of the present invention to provide a tube container of the type set forth above which permits use of a neck portion of the usually employed type thereby reducing costs.

A still further object of the present invention is to provide a tube container in which a dead space between an outlet and a body is minimized so as to reduce amount of the semifluid material to be remained therein.

A still further object of the present invention is the provision of a tube container which will not have an undesirable external appearance.

SUMMARY OF THE INVENTION

According to the present invention, a tube container for receiving semifluid material comprises a tubular body formed of a synthetic resin material capable of being deformed by the application of exterior pressure and having elasticity for restoring the body to its original shape upon removal of pressure, a hollow neck portion formed of a synthetic resin material and adapted to be covered by a cap, and a valve member. The tubular body is open at an upper end thereof and is sealed at a lower end thereof after the body is filled with the semifluid material The neck portion includes an outlet provided at a top end thereof and also includes a shoulder at which the neck portion is integrally mounted on the upper end of the tubular body. An inner surface of the neck portion is formed with circumferentially extending grooves. The valve member is inserted into the neck portion from the lower end of the body before sealing thereof and includes a side wall, a lower open end, an upper end plate, a valve sheet, a stopper means and a flange. The side wall has an outer surface tightly fitting with an inner surface of the neck portion having an inwardly tapered upper end and circumferentially extending protrusions extending into and in engagement with the grooves of the neck portion. The end plate is provided with a passage for communicating the interior of the tubular body with the outlet. Positioned on the end plate is the valve sheet which is movable upwardly and downwardly between the end plate and the stopper means. The valve sheet is moved upwardly to open the passage when exterior pressure is applied to the tubular body, and is moved downwardly to close the passage when the pressure to the tubular body is removed. The stopper means comprises a plurality of pawls extending upwardly from an upper surface of the end plate and being circumferentially apart from each other. Upper portions of the pawls define a space of less diameter than that of the valve sheet and are located adjacent to the outlet of the neck portion. The flange is formed at a lower end of the valve member and abuts the shoulder of the neck portion.

Other objects, features and advantages of the present invention will be apparent from the following detailed description of preferred embodiments thereof when taken in conjunction with the accompanying drawings, in which:

DETAILED DESCRIPTION OF THE INVENTION

Figure 3:
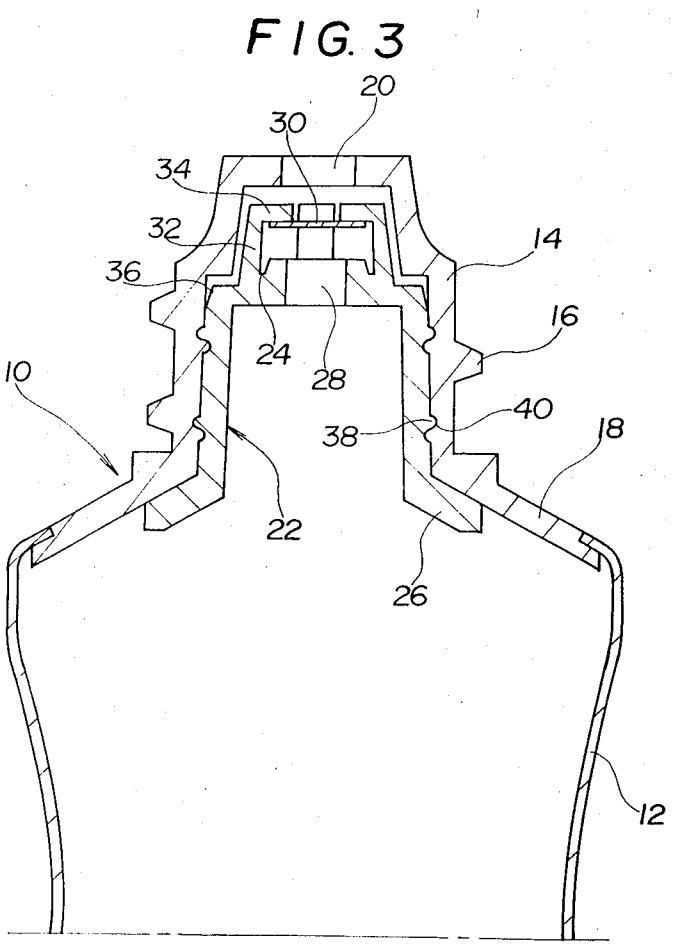
FIG. 3 is a view similar to FIG. 1, but illustrating the body of the container being pressed.
Figure 1:
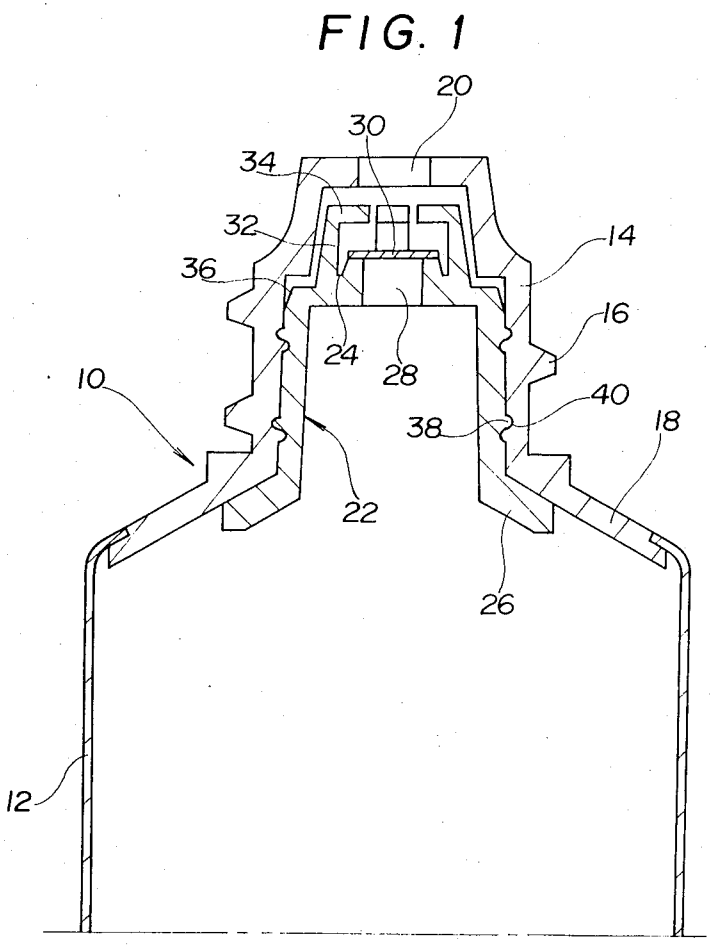
FIG. 1 is a sectional view of a part of a tube container in accordance with an embodiment of the present invention.
Figure 2:
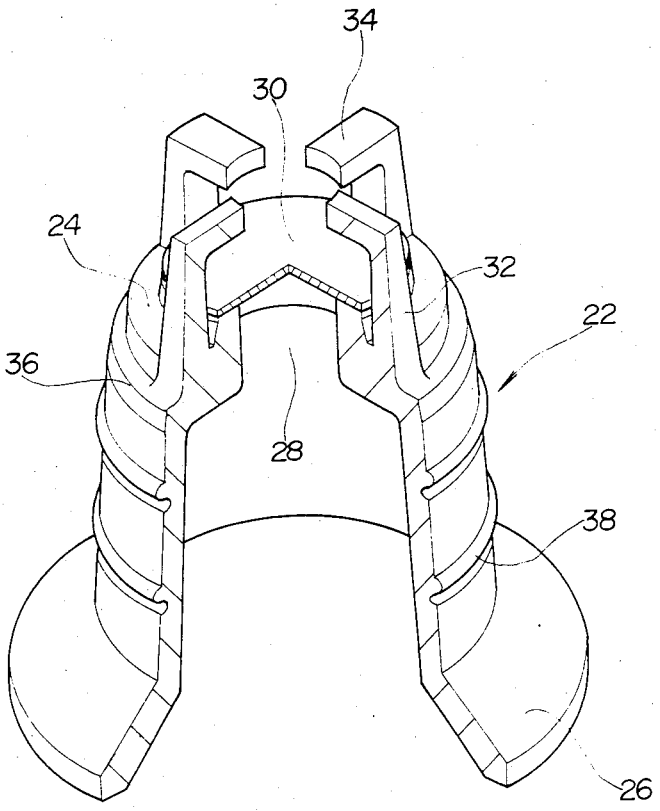
FIG. 2 is a partially sectioned perspective view illustrating a valve member in FIG. 1.

Referring to FIGS. 1 to 3, there is shown a tube container according to a preferred embodiment of the present invention. The tube, generally indicated by numeral 10, mainly comprises a hollow body 12 of cylindrical shape, or any other suitable shape, and a hollow neck portion 14 having a thread 16 for engaging a cap (not shown) thereon. The cylindrical body 12 is made of a synthetic resin material having such nature that permits the body 12 to elastically expand or be restored to its original shape upon removal of pressure, for example, olefine resin, and is formed by means of extrusion molding. The neck portion 14 may be formed by injection molding of resin material and is integrally mounted on the upper open end of the body 12 at a conical shoulder 18. Semifluid cosmetic material, ointment, food and the like may be filled into the body 12 before a bottom thereof (not shown) is sealed, and the semifluid contents will be extruded from an outlet 20 formed in an upper end of the neck portion 14 when the body 12 is pressed by a user, as in the conventional container of this kind.

According to the present invention, the tube container 10 includes a valve member 22 for preventing back flow or current of the material with air.

The valve member 22 has a configuration corresponding to the inner shape of the neck portion 14, for example a hollow cylindrical configuration, with a lower open end and an upper end plate 24. The lower end is provided with a flange 26 which extends outwardly and downwardly to be in contact with an inner surface of the shoulder 18 to prevent the semifluid material from passing therebetween. Also provided at a substantially central area of the upper end plate 24 is a passage 28 in the shape of a hole which communicates the interior of the body 12 with the outlet 20.

A valve sheet 30, having a diameter greater than that of the passage hole 28, is placed on an upper surface of the end plate 24 for vertical movement between the upper surface and a stopper means as hereinafter described. Preferably, the valve sheet 30 may be formed of a synthetic resin material of 100μ to 300μ thickness or may be formed of a stainless steel of 20μ to 30μ thickness. It is readily understood that the valve sheet 30 is intended to close the passage 28 when it is located on the end plate 24 as shown in FIG. 1, and that the passage 28 may be of any suitable form such as plural small eyelets, instead of the single hole, coverable by the valve sheet 30. Upward movement of the sheet 58 will be restrained by hook portions 34 each extending inwardly from an upper end of a pawl 32. The pawls 32 project upwardly from the end plate 24 and, as best shown in FIG. 2, four pawls are provided at a marginal portion of the end plate 24 at regular intervals in circumferential direction. The hook portions 34 are located so adjacently to the outlet 20 that a space therebetween may be minimized without preventing smooth flow of the material.

Insertion of the valve member 22 into the neck portion 14 is carried out from the bottom of the body 12 before filling the semifluid material therein. An inwardly tapered upper edge 36 of the side wall of the member 22 will make the insertion smooth and the flange 26 will not permit the valve member 22 to be inserted upside down into the neck portion 14. An outer diameter of the valve member 22 except for the flange portion 26 is determined so that a tight fit may be obtained between the outer surface of the member 22 and the inner surface of the neck portion 14. Further, the outer surface of the side wall of member 22 has circumferentially extending protrusions 38 which extend into and are engagement into grooves 40 formed in the inner surface of the neck portion 14, thereby providing complete sealing between the member 22 and the neck portion 14.

Assuming now that the cap (not shown) is disengaged from the neck portion 14 and the valve sheet 30 is in its lower position, i.e. on the end plate 24, as shown in FIG. 1, when the elastic body 12 is pressed or squeezed by a hand of the user, a pressure inside of the body 12 is increased, which causes the valve sheet 30 to move upwardly until the circumferential edge thereof comes into contact with the hook portions 34 of the pawls 32 thereby being prevented from further elevation, as shown in FIG. 2. The semifluid material contained in the body 12 then passes through the hole 28 in the upper end plate 24 and a space defined between the circumferential edge of the valve sheet 30 and the inner surface of the neck portion 14 except for the points where the pawls 32 are located, the material being extruded from the outlet 20.

Immediately after the force applied to the body 12 is removed, the body 12 tends to be restored to its original shape due to the elasticity thereof, thus causing a reduced pressure within body 12 that tends to suck the material in the neck portion 14, as well as the material having been extruded from the outlet 20, into the body 12 through the passage 28. According to the present invention, however, the valve sheet 30 is immediately moved to its lower position, i.e. on the end plate 24, due to reduced pressure or suction force thereby closing the passage 28 to prevent the back flow of the material and the air into the body 12.

It should be noted here that the suction force exerted in the body 12 will continue until pressure again is applied to the body 12 by the user, since the reduced volume in the body 12 continues to tend to elastically restore the body 12 to its original shape. Thus, sealing of the passage 28 provided by the valve sheet 30 will also continue. Further, as the quantity of material in the body 12 is reduced by use, the suction force increases to provide a stronger hermetic seal of the passage 28.

As already discussed, the valve sheet 30 is movable between the upper end plate 24 and the hook portions 34 of pawls 32. The semifluid material filling the space between the hook portion 34 and the outlet 20 when the valve sheet 30 is in the position of FIG. 3, remains outside of the valve member 22 together with the air after the passage is closed by the valve sheet 30. Such remaining material is first extruded when the body again is squeezed. However, since the hook portions 34 are located adjacent to the outlet 20, the volume of remaining material is minimized which enables the customer to always use the fresh material from the body 12 without wasting every initial extrusion. Further, the above location of the valve sheet 30 reduces the volume of air sucked into the neck portion 14 when the pressure to the body 12 is removed. The valve sheet 30 need not move for a long distance so that it can quickly close the passage 28.

The neck portion 14 has the shape and structure as usually employed in tube-type containers, and the valve member 22 may be formed to have an outer shape corresponding to an inner shape of the neck portion 14 for insertion into the latter. Therefore, if it would happen that any molded container requires additional structure for preventing the back flow, such a requirement may be satisfied by inserting the valve member without reforming the container itself. A manufacturer need not prepare a new mold for a neck portion of any unusual shape. The valve member 22 fitted inside the neck portion 14 never spoils an external appearance of the tube 10, and the cap is threadedly engageable with the neck portion 14 as in the conventional tube container.

Instead of providing the hook portions 34, the pawls 32 may be inclined in a direction toward the center of the end plate 24 so that a ring-like space defined by upper edges of the inclined pawls will have a smaller diameter than that of the valve sheet 30.

Although the present invention has been described with regard to the preferred embodiments thereof, many modifications and alterations may be made within the scope of the present invention.

What is claimed is:

1. A tube container for receiving semifluid material, said container comprising:

a tubular body formed of a synthetic resin material capable of being deformed by the application of exterior pressure and having elasticity for restoring said tubular body to its original shape upon removal of the exterior pressure, said tubular body being open at an upper end thereof, a lower end of said tubular body being sealed after said tubular body is filled with a semifluid material;

a hollow neck portion formed of a synthetic resin material and adapted to be covered by a cap, said neck portion including an outlet provided at a top end thereof and a shoulder, an inner surface of said neck portion being formed with circumferentially extending grooves, and said neck portion being integrally mounted on said upper end of said tubular body at said shoulder; and a valve member inserted into said neck portion from said lower end of said tubular body before sealing thereof, said valve member including a side wall, a lower open end, an upper end plate, a valve sheet, a stopper means and a flange, said side wall having an outer surface tightly fitting with an inner surface of said neck portion, said outer surface having an upper end tapering inwardly from the portion of the outer surface that tightly fits with the inner surface of the neck portion and further having circumferentially extending protrusions extending into and in engagement with said grooves of said neck portion, said end plate being provided with a passage for communicating the interior of said tubular body with said outlet, said valve sheet being positioned on said end plate and being movable upwardly and downwardly between said end plate and said stopper means, said valve sheet being movable upwardly to open said passage when exterior pressure is applied to said tubular body, and said valve sheet being movable downwardly to close said passage when the pressure to said tubular body is removed, said stopper means comprising a plurality of pawls extending upwardly from an upper surface of said end plate and being circumferentially apart from each other, upper portions of said pawls defining a space of less diameter than that of said valve sheet, and said upper portions of said pawls being located adjacent to said outlet of said neck portion so as to minimize a space therebetween, and said flange being formed at a lower end of said valve member and abutting said shoulder of said neck portion.

2. A tube container as claimed in claim 1, wherein said upper portion of each said pawl includes a hook extending inwardly therefrom.

3. A tube container as claimed in claim 1, wherein said passage is in the form of a hole provided substantially at a center portion of said end plate.

* * * * *